US010140926B2

(12) United States Patent
Shim et al.

(10) Patent No.: US 10,140,926 B2
(45) Date of Patent: Nov. 27, 2018

(54) DISPLAY DEVICE AND ELECTRONIC DEVICE HAVING THE SAME

(71) Applicant: Samsung Display Co., Ltd, Yongin-si, Gyeonggi-do (KR)

(72) Inventors: Jung-Hoon Shim, Asan-si (KR); Chae-Han Hyun, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 130 days.

(21) Appl. No.: 15/382,008

(22) Filed: Dec. 16, 2016

(65) Prior Publication Data

US 2017/0186362 A1 Jun. 29, 2017

(30) Foreign Application Priority Data

Dec. 29, 2015 (KR) ..... 10-2015-0188279

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0426* (2013.01); *G09G 2300/0861* (2013.01); *G09G 2310/0251* (2013.01); *G09G 2310/0262* (2013.01); *G09G 2310/0286* (2013.01)

(58) Field of Classification Search
CPC ..... G09G 3/30–3/3291
See application file for complete search history.

(56) References Cited

U.S. PATENT DOCUMENTS 7,782,276 B2 * 8/2010 Shin ..... G09G 3/325 315/169.3
8,031,141 B2 * 10/2011 Shin ..... G09G 3/325 345/100
9,368,069 B2 * 6/2016 Woo ..... G09G 3/3266
9,454,934 B2 * 9/2016 Woo ..... G09G 3/3266
2017/0352328 A1 * 12/2017 Jeong ..... G09G 3/3266
2018/0075810 A1 * 3/2018 Kim ..... G09G 3/3266

FOREIGN PATENT DOCUMENTS

WO 2005/088596 A1 9/2005

* cited by examiner

*Primary Examiner* — Gene W Lee
(74) *Attorney, Agent, or Firm* — Innovation Counsel LLP

(57) ABSTRACT

A display device includes a pixels unit and a driving unit. The driving unit includes an emission driver coupled to a first clock line and a second clock line and configured to receive therefrom a first clock signal and a second clock signal, respectively, and to generate an emission control signal provided to the pixels based on the first clock signal and the second clock signal and a scan driver coupled to the emission driver through a first coupling line and a second coupling line, the scan driver configured to receive the first clock signal and the second clock signal from the emission driver and to generate a scan signal provided to the pixels based on the first clock signal and the second clock signal.

20 Claims, 7 Drawing Sheets

DISPLAY DEVICE AND ELECTRONIC DEVICE HAVING THE SAME

CROSS-REFERENCE TO RELATED APPLICATION(S)

This application claims priority under 35 USC §119 to Korean Patent Application No. 10-2015-0188279, filed on Dec. 29, 2015 in the Korean Intellectual Property Office (KIPO), the contents of which are incorporated herein in its entirety by reference.

BACKGROUND

1. Technical Field

Example embodiments relate generally to a display device and an electronic device having the same. More particularly, embodiments of the present inventive concept relate to a pixel and a display device having the same.

2. Description of the Related Art

A display device includes a scan driver and an emission driver. The scan driver provides a scan signal to a display panel. The scan driver and the emission driver may be operated by receiving a plurality of signals from a driving integrated circuit coupled to the display panel. The display panel may be vulnerable to static electricity as signals provided from the driving integrated circuit increases and, therefore, a number of pads required to couple the display panel and the driving integrated circuit increases. Further, area required for layout may increase as the number of pads increases.

SUMMARY

Some example embodiments provide a display device capable of decreasing a number of signals provided to a scan driver and an emission driver.

Some example embodiments provide an electronic device capable of decreasing a number of signals provided to a scan driver and an emission driver.

According to an aspect of example embodiments, a display device may include a pixel unit including a plurality of pixels and a driving unit formed on a non-display area adjacent to the pixel unit, the driving unit configured to drive the pixels. The driving unit may include an emission driver coupled to a first clock line and a second clock line and configured to receive therefrom a first clock signal and a second clock signal, respectively, and to generate an emission control signal provided to the pixels based on the first clock signal and the second clock signal and a scan driver coupled to the emission driver through a first coupling line and a second coupling line, the scan driver configured to receive the first clock signal and the second clock signal from the emission driver and to generate a scan signal provided to the pixels based on the first clock signal and the second clock signal.

In example embodiments, the emission driver may sequentially generate the emission control signal based on an emission start signal, the first clock signal, and the second clock signal.

In example embodiments, the emission driver includes a plurality of emission stages that generates the emission control signal provided to the pixels.

In example embodiments, a first emission stage may generate the emission control signal based on an emission start signal, the first clock signal, and the second clock signal and provide the emission control signal to the pixels in a first column.

In example embodiments, an Nth emission stage may generate the emission control signal based on a carry signal provided from an (N−1)th emission stage, the first clock signal, and the second clock signal and provide the emission control signal to the pixels in an Nth column, where the N is an integer equal to or greater than 2.

In example embodiments, the scan driver may sequentially generate the scan signal based on a scan start signal, the first clock signal, and the second clock signal.

In example embodiments, the scan driver may include a plurality of scan stages that generates the scan signal provided to the pixel.

In example embodiments, the scan driver may include a dummy scan stage.

In example embodiments, the dummy scan stage may generate the scan signal based on a scan start signal, the first clock signal, and the second clock signal and provide the scan signal to the pixels in a first column as a first scan signal.

In example embodiments, a first scan stage may generate the scan signal based on a carry signal provided from the dummy scan stage, the first clock signal, and the second clock signal, provide the scan signal to the pixels in a first column as a second scan signal, and provide the scan signal to the pixels in a second column as a first scan signal.

In example embodiments, an Nth scan stage may generate the scan signal based on a carry signal provided from an (N−1)th scan stage, the first clock signal, and the second clock signal, provide the scan signal to the pixels in an Nth column as a second scan signal, and provide the scan signal to the pixels in an (N+1)th column as a first scan signal, where the N is an integer equal to or greater than 2.

In example embodiments, a plurality of pads may be formed in the non-display area, and the plurality of pads may be coupled to a driving circuit and receive therefrom the first clock signal, the second clock signal, a scan start signal, and an emission start signal.

According to an aspect of example embodiments, an electronic device may include a display device and a processor that controls the display device. The display device may include a pixel unit including a plurality of pixels and a driving unit formed on a non-display area adjacent to the pixel unit, the driving unit configured to drive the pixels. The driving unit may include an emission driver coupled to a first clock line and a second clock line and configured to receive therefrom a first clock signal and a second clock signal, respectively, and to generate an emission control signal provided to the pixels based on the first clock signal and the second clock signal and a scan driver coupled to the emission driver through a first coupling line and a second coupling line, the scan driver configured to receive the first clock signal and the second clock signal from the emission driver and to generate a scan signal provided to the pixels based on the first clock signal and the second clock signal.

In example embodiments, the emission driver may include a plurality of emission stages that sequentially generates the emission control signal based on an emission start signal, the first clock signal, and the second clock signal.

In example embodiments, the scan driver may include a plurality of scan stages that sequentially generates the scan signal based on a scan start signal, the first clock signal, and the second clock signal.

In example embodiments, the scan driver may include a dummy scan stage.

In example embodiments, the dummy scan stage may generate the scan signal based on a scan start signal, the first clock signal, and the second clock signal and provide the scan signal to the pixels in a first column as a first scan signal.

In example embodiments, the first scan stage may generate the scan signal based on a carry signal provided from the dummy scan stage, the first clock signal, and the second clock signal, provide the scan signal to the pixels in a first column as a second scan signal, and provide the scan signal to the pixels in a second column as a first scan signal.

In example embodiments, an Nth scan stage may generate the scan signal based on a carry signal provided from an (N−1)th scan stage, the first clock signal, and the second clock signal, provide the scan signal to the pixels in an Nth column as a second scan signal, and provide the scan signal to the pixels in an (N+1)th column as a first scan signal, where the N is an integer equal to or greater than 2.

In example embodiments, a plurality of pads may be formed in the non-display area, and the plurality of pads may be coupled to a driving circuit and receive therefrom the first clock signal, the second clock signal, a scan start signal, and an emission start signal.

Therefore, a display device and an electronic device having the same may decrease a number of pads that couples a display panel and a driving integrated circuit by commonly using clock signals provided to a scan driver and an emission driver in the display panel. Thus, defects due to static electricity on the pad may decrease. Further, a dead space of the display panel may be reduced as the number of lines that provide the clock signal decreases.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Hereinafter, the present inventive concept will be explained in detail with reference to the accompanying drawings.

Figure 1:
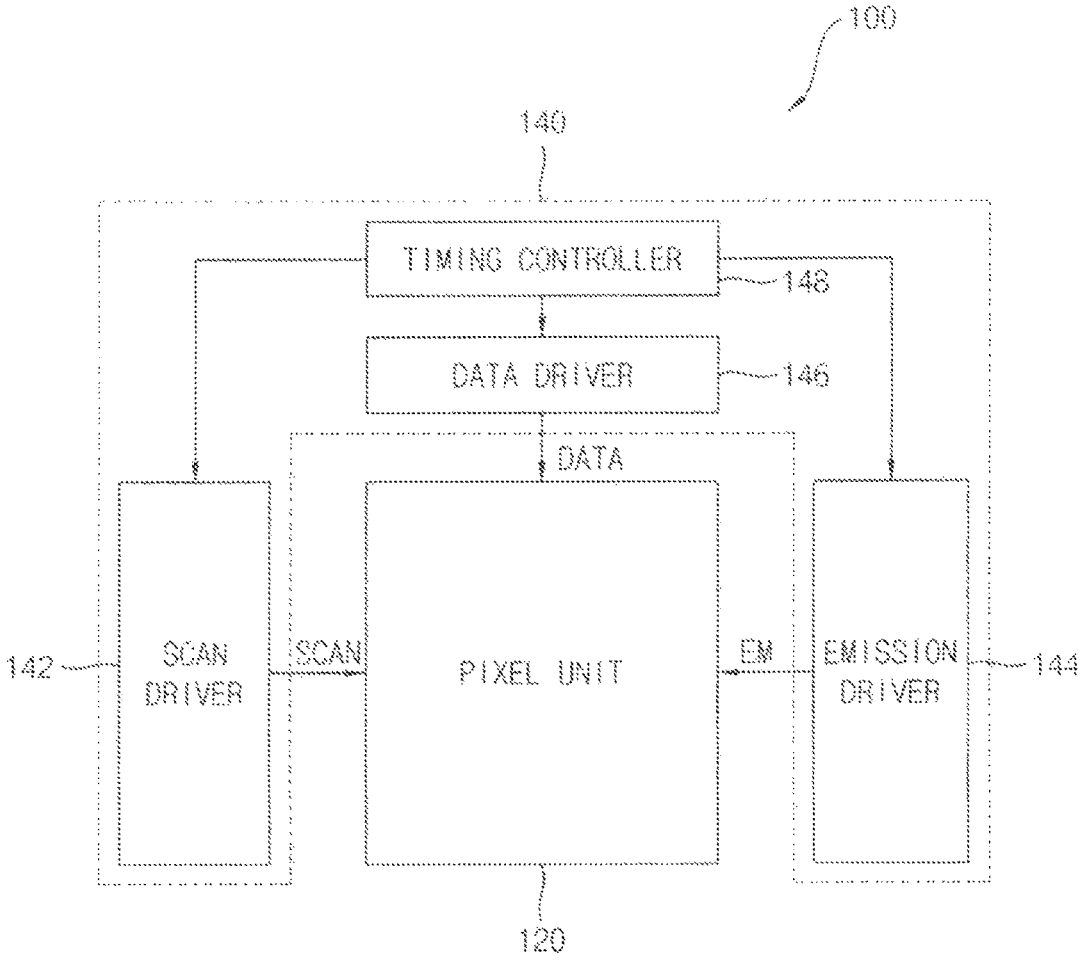
FIG. 1 is a block diagram illustrating a display device according to example embodiments.
Figure 2:
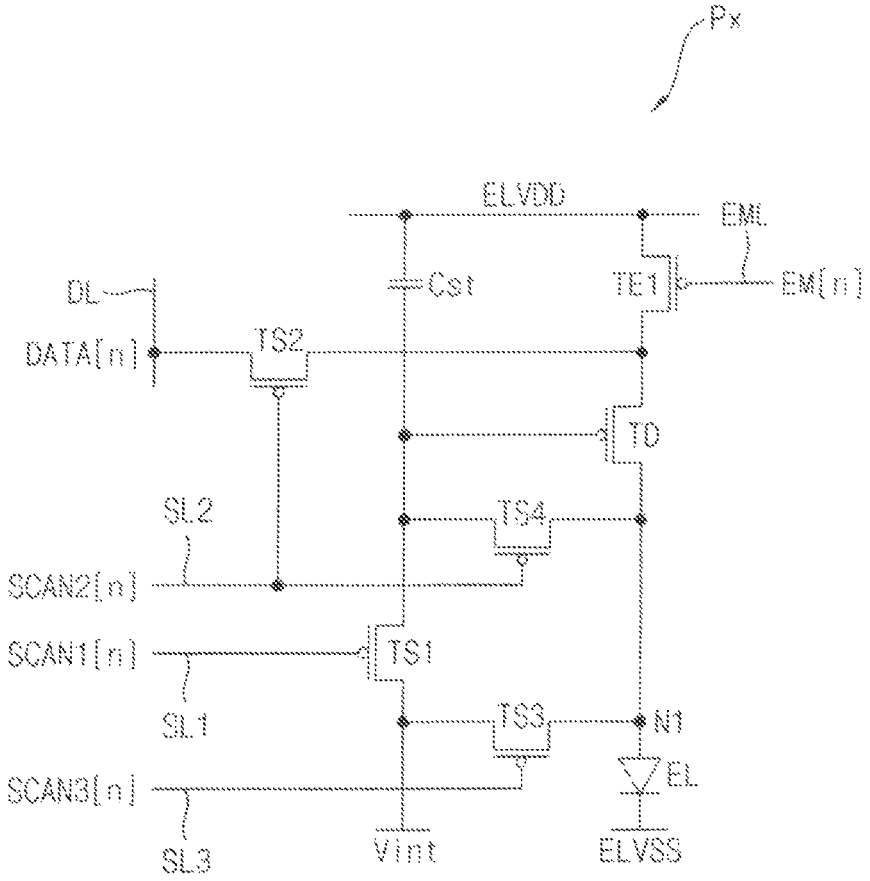
FIG. 2 is a circuit diagram illustrating an example of a pixel included in the display device of FIG. 1.

FIG. 1 is a block diagram illustrating a display device according to example embodiments, and FIG. 2 is a circuit diagram illustrating an example of a pixel included in the display device of FIG. 1.

Referring to FIG. 1, a display device 100 may include a pixel unit 120 and a driving unit 140.

The pixel unit 120 may include a plurality of pixels. The pixel unit 120 may be coupled to a data driver 146 of the driving unit 140 through a plurality of data lines, coupled to a scan driver 142 of the driving unit 140 through a plurality of scan lines, and coupled to an emission driver 144 of the driving unit 140 through a plurality of emission control lines. The pixel unit 120 may include the plurality of pixels formed in intersection regions of the plurality of data lines and the plurality of scan lines. Each of the pixels may be operated in response to signals provided from the driving unit 140. For example, the pixel unit 120 may include a pixel illustrated in FIG. 2.

Referring to FIG. 2, each of the pixels Px in the pixel unit 120 may include a driving transistor TD, a first switching transistor TS1, a second switching transistor TS2, a third switching transistor TS3, a fourth switching transistor TS4, a storage capacitor Cst, an emission control transistor TE1, and an organic light emitting diode EL.

The driving transistor TD may generate a driving current that operates the organic light emitting diode EL in response to a data signal provided through the data line DL. A first terminal of the driving transistor TD may be coupled to the emission control transistor TEL The driving transistor TD1 may receive a power signal ELVDD when the emission control transistor TE1 turns on. A second terminal of the driving transistor TD may be electrically coupled to the organic light emitting diode EL. The driving current generated in the driving transistor TD may be provided to the organic light emitting diode EL.

The first switching transistor TS1 may turn on in response to a first scan signal SCAN1 and initialize a gate electrode of the driving transistor TD into an initialization voltage Vint. A first terminal of the first switching transistor TS1 may be coupled to an initialization power line. A second terminal of the first switching transistor TS1 may be coupled to the gate electrode of the driving transistor TD. A gate electrode of the first switching transistor TS1 may be coupled to a first scan line SL1 and may receive the first scan signal SCAN1 through the first scan line SL1. The first switching transistor TS1 may turn on, and the initialization voltage Vint may be provided to the gate electrode of the driving transistor TD through the first switching transistor TS1 when the first switching transistor TS1 turns on in response to the first scan signal SCAN1. Here, the initialization voltage Vint may have the same voltage level with the initialization voltage Vint provided to a first node N1.

The second switching transistor TS2 and the fourth switching transistor TS4 may turn on in response to the second scan signal SCAN2. A data signal DATA may be stored in the storage capacitor Cst through the second switching transistor TS2 and the fourth switching transistor TS4. A first terminal of the second switching transistor TS2 may be coupled to the data line DL, and a second terminal of the second switching transistor TS2 may be coupled to the first terminal of the driving transistor TD. A gate electrode of the second switching transistor TS2 may be coupled to the second scan line SL2 and receive the second scan signal SCAN2 through the second scan line SL2. Further, a first terminal of the fourth switching transistor TS4 may be coupled to the second scan line SL2. A gate electrode of the fourth switching transistor T4 may receive the second scan signal SCAN2 through the second scan line SL2. The data signal DATA may be stored in the storage capacitor Cst through the second switching transistor TS2 and the fourth switching transistor TS4 when the second switching transistor TS2 and the fourth switching transistor TS4 turn on in response to the second scan signal SCAN2.

The storage capacitor Cst may store the data signal DATA and control an operation of the driving transistor TD.

The third switching transistor TS3 may initialize the first node N1, which is coupled to an anode electrode of the organic light emitting diode EL, as the initialization voltage Vint in response to a third scan signal SCAN3. A first terminal of the third switching transistor TS3 may be coupled to an initialization power line, and a second terminal of the third switching transistor TS3 may be coupled to the first node N1. A gate electrode of the third transistor TS3 may be couple to a third scan line SL3 and receive the third scan signal SCAN3 through the third scan line SL3. The initialization voltage Vint maybe provided to the first node N1 through the initialization line coupled to the first node of the third switching transistor TS3 when the third switching transistor TS3 turns on in response to the third scan signal SCAN3.

The emission control transistor TE1 may turn on in response to an emission control signal EM. A first terminal of the emission control transistor TE1 may be coupled to a power supply line, and a second terminal of the emission control transistor TE1 may be coupled to the first terminal of the driving transistor TD. A gate electrode of the emission control transistor TE1 may be coupled to an emission control line EML and receive the emission control signal EM. The driving current generated in the driving transistor TD may be provided to the first node N1 through the emission control transistor TE1 when the emission control transistor TE1 turns on in response to the emission control signal EM. The organic light emitting diode EL may emit light based on the driving current.

The driving unit 140 may be formed in a non-display area of a display panel adjacent to the pixel unit 120. The driving unit 140 may operate the pixels unit 120. The driving unit 140 may include the scan driver 142, the emission driver 144, the data driver 146, and a timing controller 148.

The scan driver 142 may receive a first clock signal and a second clock signal. The scan driver 142 may generate the scan signal SCAN provided to the pixels based on the first clock signal and the second clock signal. Here, the scan driver 142 may be coupled to the emission driver 144 using a first coupling line and a second coupling line. The scan driver 142 may receive the first clock signal and the second clock signal through the first coupling line and the second coupling line. The scan driver 142 may include a plurality of scan stages that generate the scan signal SCAN provided to the pixels. The scan driver 142 may include a dummy scan stage. The dummy scan stage may generate the scan signal SCAN based on a scan start signal, the first clock signal, and the second clock signal and provide the scan signal SCAN to the pixels in a first column as the first scan signal SCAN1. Here, a driving circuit may provide the scan start signal, the first clock signal, and the second clock signal through pads coupled to the driving circuit. The dummy scan stage may generate a carry signal and provide the carry signal to a first scan stage. The first scan stage may generate the scan signal SCAN based on the carry signal provided from the dummy scan stage, the first clock signal provided through the first coupling line, and the second clock signal provided through the second coupling line. Here, the carry signal may be provided from the dummy scan stage. The first clock signal and the second clock signal may be provided from a first emission stage through the first coupling line and the second coupling line. The first scan stage may provide the scan signal SCAN to the pixels in the first column as the second scan signal SCAN2 and to the pixels in a second column as the first scan signal SCAN1. Further, the first scan stage may generate a carry signal and provide the carry signal to the second scan stage. That is, an Nth scan stage may generate the scan signal SCAN based on the carry signal provided from an (N−1)th scan stage, the first clock signal provided through the first coupling line, and the second clock signal provided through the second coupling line, wherein the N is an integer equal to or greater than 2. Here, the carry signal may be provided from the (N−1)th scan stage. The first clock signal and the second clock signal may be provided from an Nth emission stage through the first coupling line and the second coupling line. The Nth scan stage may provide the scan signal SCAN to the pixels in an Nth column as the second scan signal SCAN2 and to the pixels in an (N+1)th column as the first scan signal SCAN1.

The emission driver 144 may be coupled to a first clock line and a second clock line, receive the first clock signal and the second clock signal respectively therefrom, and generate the emission control signal EM provided to the pixels based on the first clock signal and the second clock signal. The emission driver 144 may include a plurality of emission stages that generate the emission control signal EM provided to the pixel. The first emission stage may generate the emission control signal EM based on an emission start signal, the first clock signal, and the second clock signal and provide the emission control signal EM to the pixels in the first column. Here, the driving circuit may provide the emission start signal, the first clock signal, and the second clock signal through pads coupled to the driving circuit. The first emission stage may generate a carry signal and provide the carry signal to a second emission stage. Further, the first emission stage may provide the first clock signal and the second clock signal to the first scan stage through the first clock line and the second clock line. The second emission stage may generate the emission control signal EM based on the carry signal provided from the first emission stage, the first clock signal provided through the pad, and the second clock signal provided through the pad and provide the emission control signal EM to the pixels in the second column. That is, an Nth emission stage may generate the emission control signal EM based on the carry signal provided from an (N−1)th emission stage, the first clock signal, and the second clock signal provided through the pads and provide the emission control signal EM to the pixels in the Nth column. Further, the Nth emission stage may provide the first clock signal and the second clock signal to the Nth scan stage.

The plurality of pads may be formed in the non-display area of the display panel. The plurality of pads may be coupled to the driving circuit. The display panel may be coupled to the driving circuit through the pads. The driving circuit may provide driving signals to the pads. For example, the driving circuit may be implemented as an integrated circuit (IC) that includes the data driver and the timing controller. The pads may be coupled to a flexible printed circuit board (FPCB) on which the driving circuit implemented as the integrated circuit (IC) is mounted. In some example embodiments, the driving circuit of the display device 100 may provide the first clock signal, the second clocks signal, the scan start signal, and the emission start signal to the pads. The first clock signal may be provided to the pad formed in the non-display area and provided to the emission driver 144 through the first clock line coupled to the pad. The second clock signal may be provided to the pad formed in the non-display area and provided to the emission driver 144 through the second clock line coupled to the pad. The scan start signal may be provided to the pad formed in the non-display area and provided to the scan driver 142 through a scan start line. The emission start signal may be provided to the pad formed in the non-display area and provided to emission driver 144 through an emission start line.

As described above, the number of pads may decrease because the first clock signal and the second clock signal provided to the emission driver 144 are provided to the scan driver 142 through the first coupling line and the second coupling line. Thus, a static electricity defect may decrease. Further, a dead space may be reduced because the number of the clock lines that provides the clock signals is decrease.

The data driver 146 may convert an input data to the data signal DATA corresponding to the input data. The data driver 146 may provide the data signal DATA to the pixel unit 120 through the data line DL formed in the pixel unit 120. The timing controller 148 may control an operation of the display device 100. For example, the timing controller 148 may control the operation of the display device 100 by providing timing control signals to the scan driver 142, emission driver 144, and the data driver 146.

Figure 3:
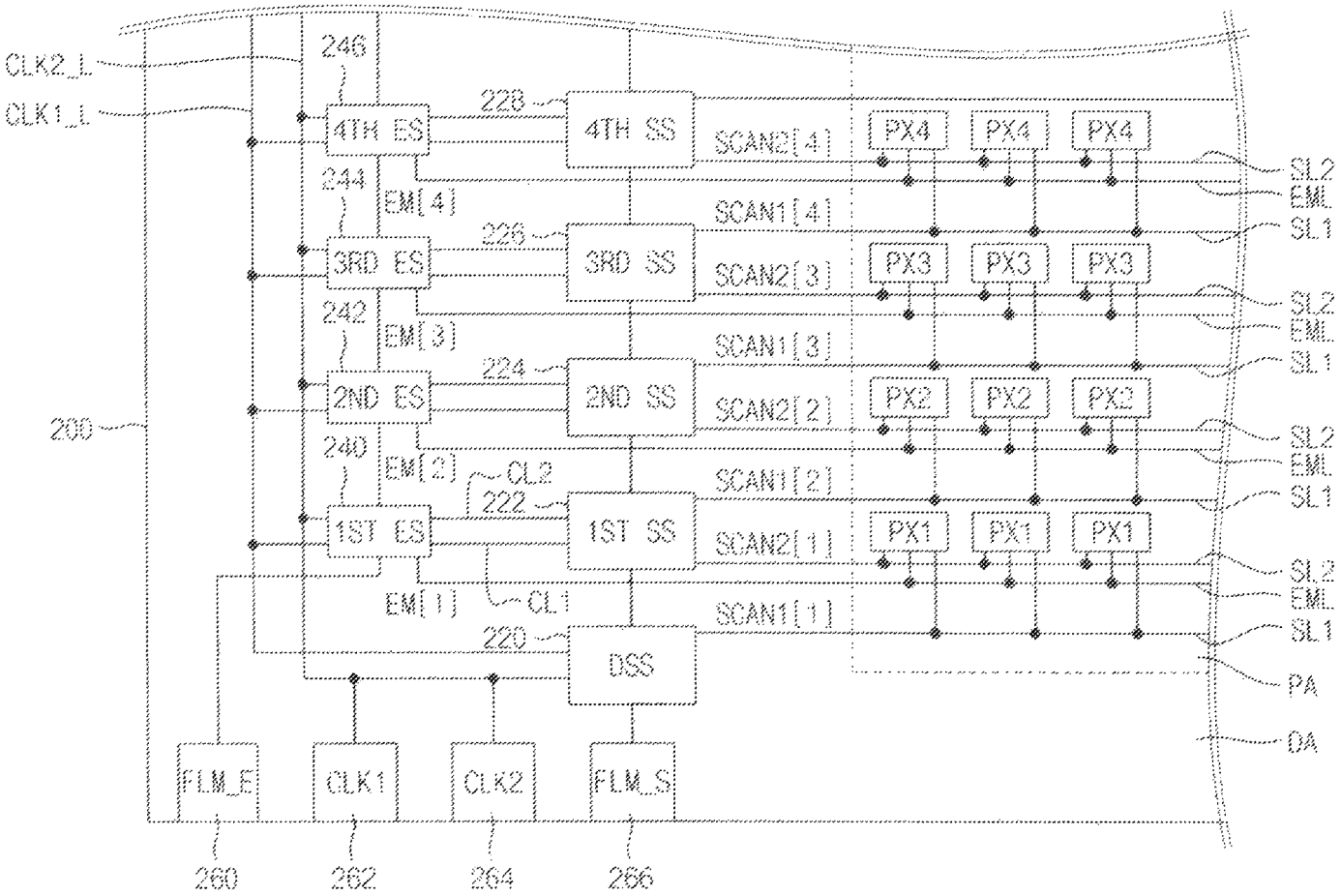
FIG. 3 is a diagram illustrating a display panel included in the transparent display device of FIG. 1.
Figure 4:
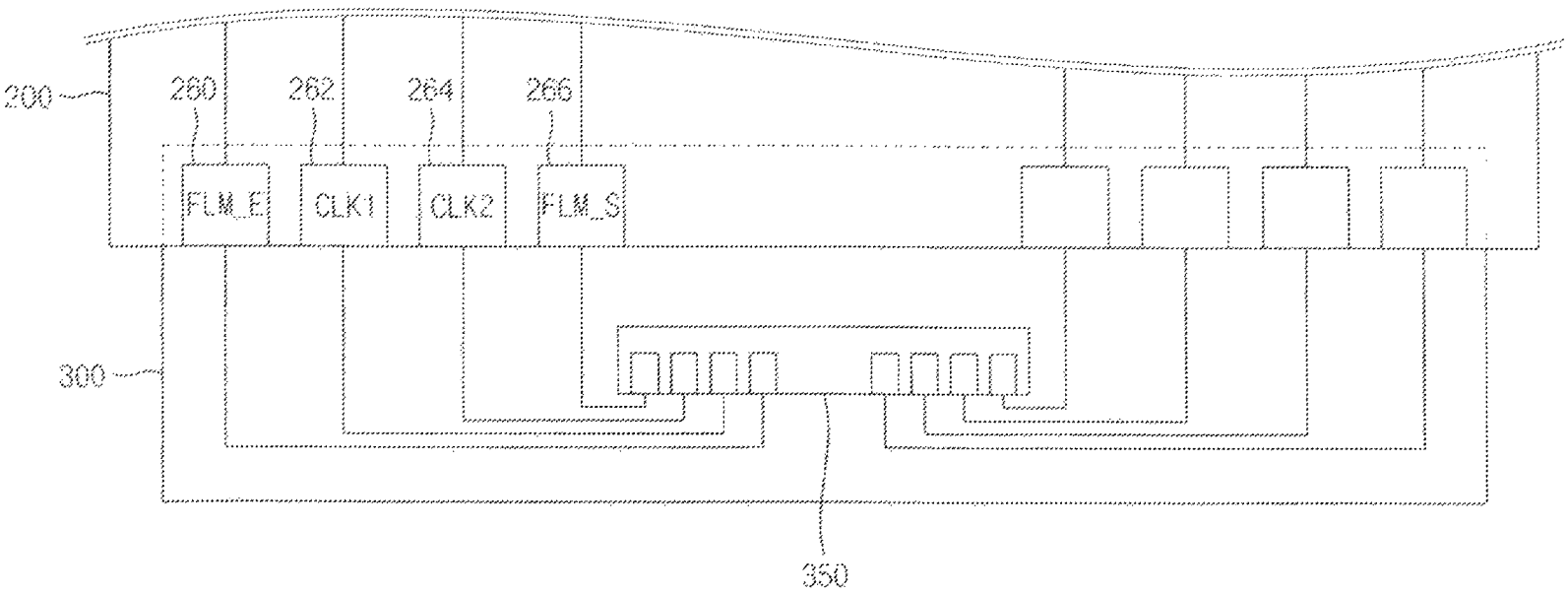
FIG. 4 is a diagram illustrating a pad unit included in the display panel of FIG. 3

FIG. 3 is a diagram illustrating a display panel included in the transparent display device of FIG. 1, and FIG. 4 is a diagram illustrating a pad unit included in the display panel of FIG. 3.

Referring to FIG. 3, a plurality of pixels PX1, PX2, PX3, PX4 may be formed in a pixel unit of the display panel 200. Each of the pixels may be coupled to an emission control line EML, a first scan line SL1, and a second scan line SL2. Each of the pixels may be coupled to a data line and a power supply line, although the data line and the power supply line are not shown in FIG. 3. Each of the pixels may receive an emission control signal through the emission control line EML, a first scan signal through the first scan line SL1, and a second scan signal through the second scan line SL2. Further, each of the pixels may receive a data signal through the data line and a high-power voltage (e.g., ELVDD) and a low-power voltage (e.g., ELVSS) through the power supply line.

An emission driver may include a plurality of emission stages 240, 242, 244, 246. A first emission stage 240 may receive an emission start signal FLM_E from a first pad 260, a first clock signal CLK1 from a second pad 262 through a first clock line CLK1_L, and a second clock signal CLK2 from a third pad 264 through a second clock line CLK2_L. The first emission stage 240 may generate an emission control signal EM[1] based on the emission start signal FLM_E, the first clock signal CLK1, and the second clock signal CLK2. The emission control signal EM[1] generated in the first emission stage 240 may be provided to the pixels PX1 in a first column through the emission control line EML. Further, the first emission stage 240 may generate a carry signal and provide the carry signal to a second emission stage 242. Alternately, the first emission stage 240 may provide the emission control signal EM[1] to the second emission stage 242 as the carry signal. The second emission stage 242 may receive the carry signal from the first emission stage 240, the first clock signal CLK1 through the first clock line CLK1_L, and the second clock signal CLK2 through the second clock line CLK2_L. The second emission stage 242 may generate an emission control signal EM[2] based on the carry signal, the first clock signal CLK1, and the second clock signal CLK2. The emission control signal EM[2] generated in the second emission stage 242 may be provided to the pixels PX2 in a second column through the emission control line EML. That is, an Nth emission stage may generate an emission control signal EM based on the carry signal provided from an (N−1)th emission stage, the first clock signal CLK1 provided through the first clock line CLK1_L, and the second clock signal CLK2 provided through the second clock line CLK2_L and provide the emission control signal EM to the pixels in the Nth column. Further, the emission stages 240, 242, 244, 246 may be coupled to scan stages 222, 224, 226, 228 through a first coupling line CL1 and a second coupling line CL2. The first clock signal CLK1 provided to the emission stages 240, 242, 244, 246 may be provided to the scan stages 222, 224, 226, 228 through the first coupling line CL1. The second clock signal CLK2 provided to the emission stages 240, 242, 244, 246 may be provided to the scan stages 222, 224, 226, 228 through the second coupling line CL2.

The scan driver may include the plurality of scan stages 220, 222, 224, 226, 228. The plurality of scan stages 220, 222, 224, 226, 228 may sequentially generate scan signals.

The scan driver may include a dummy scan stage 220. The dummy scan stage 220 may receive the first clock signal CLK1 from the second pad 262 through the first clock line CLK1_L, the second clock signal CLK2 from the third pad 264 through the second clock line CLK2_L, and the scan start signal FLM_S from the fourth pad 266. The dummy scan stage 220 may generate the scan signal based on the scan start signal, the first clock signal CLK1, and the second clock signal CLK2. The scan signal generated in the dummy scan stage 220 may be provided to the pixels PX1 in the first column as the first scan signal SCAN1[1]. Further, the dummy scan stage 220 may generate a carry signal and provide the carry signal to a first scan stage 222. Alternately, the dummy scan stage 220 may provide the scan signal to the first scan stage 222 as the carry signal.

The first scan stage 222 may receive the carry signal from the dummy scan stage 220, the first clock signal CLK1 through the first coupling line CL1, and the second clock signal CLK2 through the second coupling line CL2. The first scan stage 222 may generate a scan signal based on the carry signal, the first clock signal CLK1, and the second clock signal CLK2. The scan signal generated in the first scan stage 222 may be provided to pixels PX2 in a second column as a first scan signal SCAN1[2] through a first scan line SL1 and to the pixels PX1 in the first column as a second scan signal SCAN2[1] through a second scan line SL2. Further, the first scan stage 222 may generate a carry signal and provide the carry signal to the second scan stage 224. Alternately, the first scan stage 222 may provide the scan signal generated in the first scan stage 222 to the second scan stage 224 as the carry signal.

The second scan stage 224 may receive the carry signal from the first scan stage 222, the first clock signal CLK1 through the first coupling line CL1, and the second clock signal CLK2 through the second coupling line CL2. The second scan stage 224 may generate a scan signal based on the carry signal, the first clock signal CLK1, and the second clock signal CLK2. The scan signal generated in the second scan stage 224 may be provided to the pixels PX3 in the third column as a first scan signal SCAN1[3] through the first scan line SL1 and to the pixels PX2 in the second column as a second scan signal SCAN2[2] through the second scan line SL2.

An Nth scan stage may generate a scan signal based on the carry signal provided from an (N−1)th scan stage, the first clock signal CLK1 provided through the first coupling line CL1, and the second clock signal CLK2 provided through the second coupling line CL2. The Nth scan stage may provide the scan signal to the pixels in an (N+1)th column as the first scan signal SCAN1[N+1] through the first scan line SL1 and to the pixels in an Nth column as the second scan signal SCAN2[N] through the second scan line SL2.

The scan driver may further include scan stages that generate a third scan signal and provide it to the pixels, although the scan stages that generate the third scan signal are not described in FIG. 3.

Referring to FIG. 4, the pads 260, 262, 264, 266 may be formed in the non-display area. The pads 260, 262, 264, 266 may receive the first clock signal, the second clock signal, the scan start signal, and the emission start signal by being coupled to the driving circuit 350. For example, the pads 260, 262, 264, 266 may be coupled to a flexible printed circuit board (FPCB) 330 on which the driving circuit 350 implemented as the integrated circuit (IC) is mounted. The first pad 260 may receive the emission start signal FLM_E from the driving circuit 350 implemented as the integrated circuit through a line formed on the flexible printed circuit board 330. The second pad 262 may receive the first clock signal CLK1 from the driving circuit 350 implemented as the integrated circuit through a line formed on the flexible printed circuit board 330. The third pad 264 may receive the second clock signal CLK2 from the driving circuit 350 implemented as the integrated circuit through a line formed on the flexible printed circuit board 330. The fourth pad 266 may receive the scan start signal FLM_S from the driving circuit 350 implemented as the integrated circuit through a line formed on the flexible printed circuit board 330. The display panel 200 may further include pads for receiving signals provided from the driving circuit 350, although not shown in FIG. 4.

Figure 5:
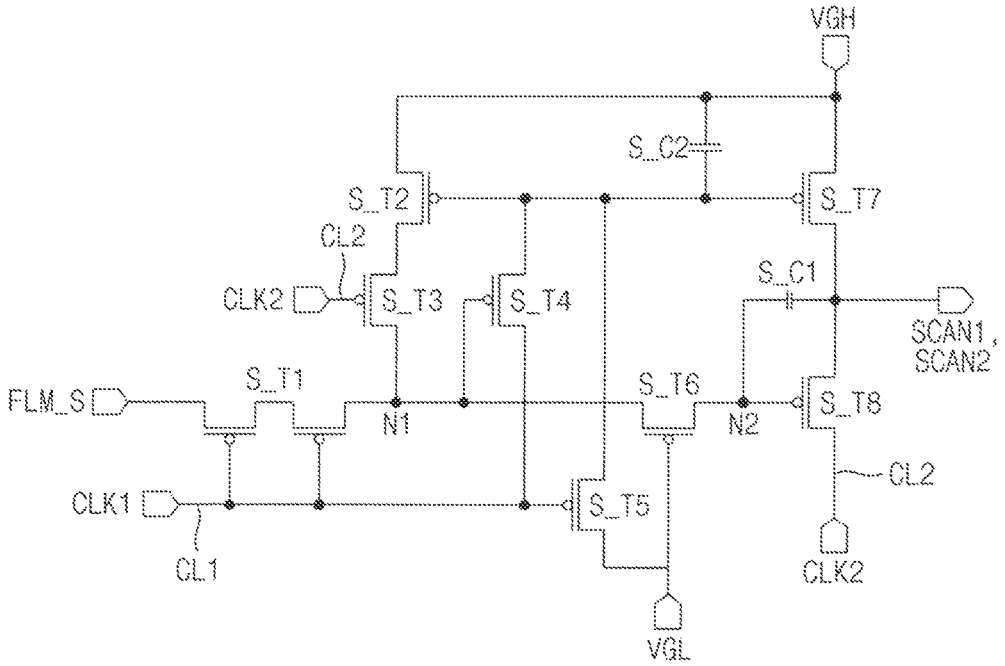
FIG. 5 is a circuit diagram illustrating an example of a scan driver included in the display device of FIG. 1.
Figure 6:
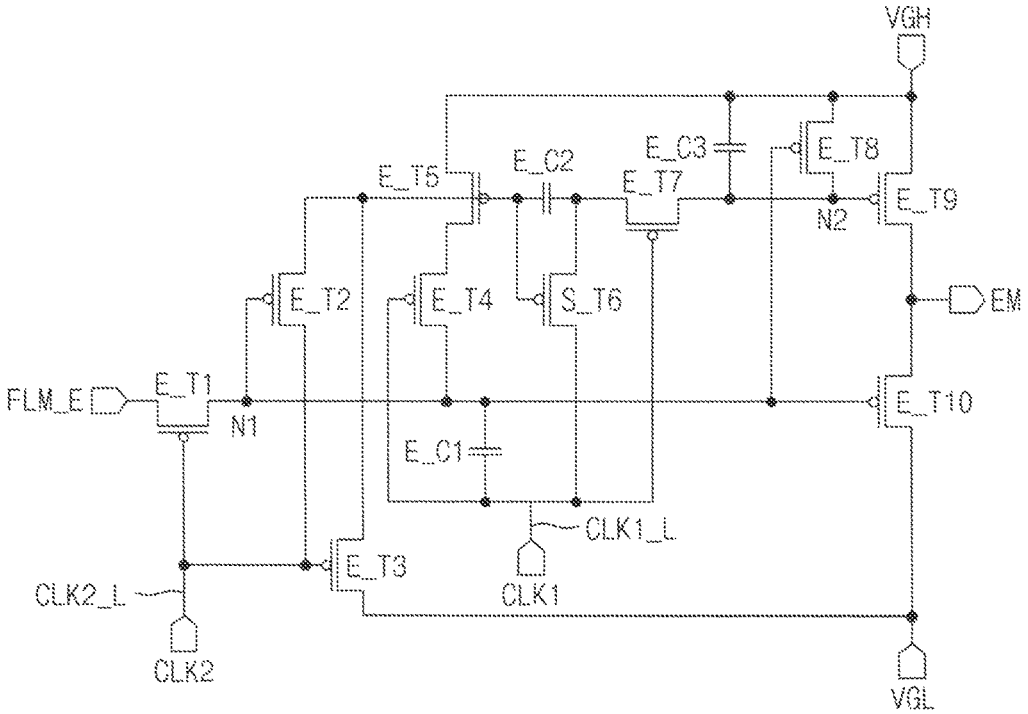
FIG. 6 is a circuit diagram illustrating an example of an emission driver included in the display device of FIG. 1.
Figure 7:
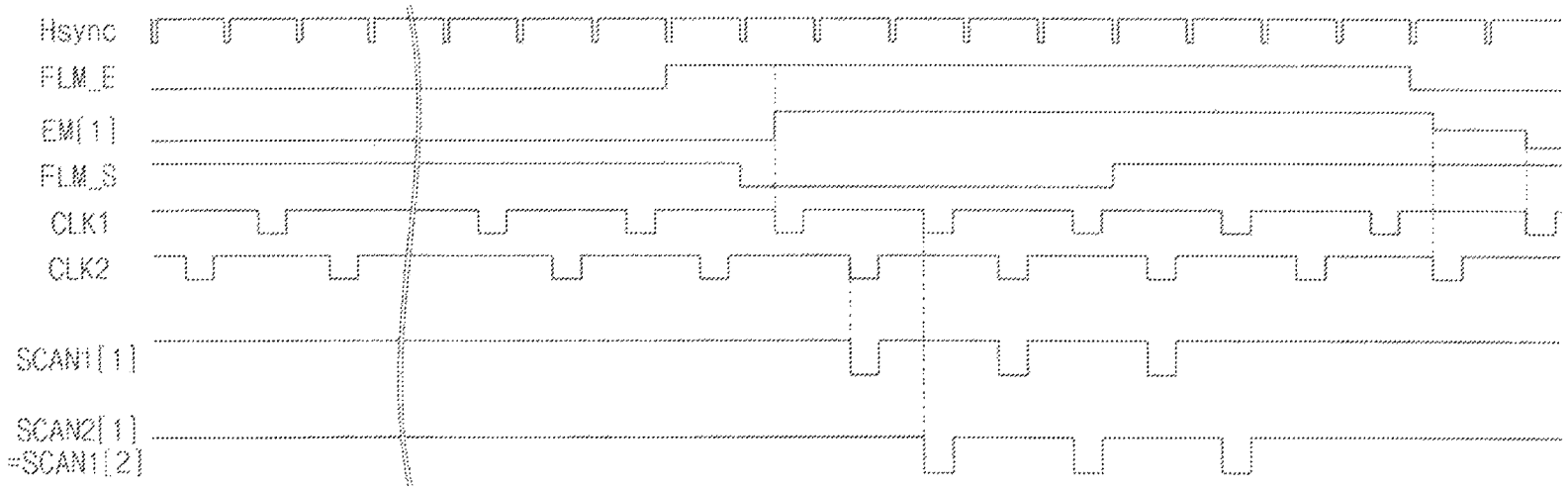
FIG. 7 is a timing diagram illustrating an example operation of a scan driver and an emission driver included in the display device of FIG. 1.

FIG. 5 is a circuit diagram illustrating an example of a scan driver included in the display device of FIG. 1, FIG. 6 is a circuit diagram illustrating an example of an emission driver included in the display device of FIG. 1, and FIG. 7 is a timing diagram illustrating an example operation of a scan driver and an emission driver included in the display device of FIG. 1.

A scan driver may include a plurality of scan stages. For example, the scan stage may be implemented as a circuit shown in FIG. 5.

Referring to FIG. 5, the scan driver may include a first switching transistor S_T1, a second switching transistor S_T2, a third switching transistor S_T3, a fourth switching transistor S_T4, a fifth switching transistor S_T5, a sixth switching transistor S_T6, a seventh switching transistor S_T7, a eighth switching transistor S_T8, a first capacitor S_C1, and a second capacitor S_C2. Although the first through eighth switching transistors are shown as being implemented as PMOS transistors in FIG. 5, the first through eighth switching transistors are not limited thereto. For example, the first through eighth switching transistors may be implemented as NMOS transistors.

A gate electrode of the first switching transistor S_T1 may be coupled to a first coupling line CL1. The first coupling line CL1 may electrically couple the scan stage and an emission stage. The emission stage may provide a first clock signal CLK1 to the first switching transistor S_T1 of the scan stage through the first coupling line CL1. A scan start signal FLM_S may be provided to a first node N1 when the first switching transistor S_T1 turns on in response to the first clock signal CLK1 provided through the first coupling line CL1.

A gate electrode of the third switching transistor S_T3 may be coupled to a second coupling line CL2. The second coupling line CL2 may electrically couple the scan stage and the emission stage. The emission stage may provide a second clock signal CLK2 to the third switching transistor S_T3 of the scan stage through the second coupling line CL2. A high-power voltage VGH provided through a power supply line may be provided to the first node N1 when the third switching transistor S_T3 turns on in response to the second clock signal CLK2 provided through the second coupling line CL2. A gate electrode of the fourth switching transistor S_T4 may be coupled to the first node N1. The fourth switching transistor S_T4 may turn on in response to a voltage provided to the first node N1. A gate electrode of the fifth switching transistor S_T5 may be coupled to the first coupling line CL1. The fifth switching transistor S_T5 may turn on in response to the first clock signal CLK1 provided through the first coupling line CL1. A gate electrode of the sixth switching transistor S_T6 may be coupled to a power supply line. The sixth switching transistor S_T6 may turn on in response to a low-power voltage VGL provided through the power supply line. A gate electrode of the eighth switching transistor S_T8 may be coupled to a second node N2. The eighth switching transistor S_T8 may be turn on in response to a voltage provided to the second node N2. As described in FIG. 7, when the scan start signal FLM_S having a low level (e.g., VGL) is provided to the scan stage, a second scan signal SCAN2[1] and a first scan signal SCAN1[1] may be generated. Here, the second scan signal SCAN2[1] may be synchronized with the first clock signal CLK1, and the first scan signal SCAN1[1] may be synchronized with the second clock signal CLK2.

The emission driver may include a plurality of emission stages. For example, the emission stage may be implemented as a circuit described in FIG. 6.

Referring to FIG. 6, the emission stage may include a first switching transistor E_T1, a second switching transistor E_T2, a third switching transistor E_T3, a fourth switching transistor E_T4, a fifth switching transistor E_T5, a sixth switching transistor E_T6, a seventh switching transistor E_T7, a eighth switching transistor E_T8, a ninth switching transistor E_T9, a tenth switching transistor E_T10, a first capacitor E_C1, a second capacitor E_C2, and a third capacitor E_C3. Although the first through tenth switching transistors are shown as being implemented as PMOS transistors in FIG. 6, the first through tenth switching transistors are not limited thereto. For example, the first through tenth switching transistors may be implemented as NMOS transistors.

A gate electrode of the first switching transistor E_T1 may be coupled to a second clock line CLK2_L. An emission start signal FLM_E may be provided to a first node N1 when the first switching transistor E_T1 turns on in response to the second clock signal CLK2 provided through the second clock line CLK2_L. A gate electrode of the second switching transistor E_T2 may be coupled to the first node N1. The second switching transistor E_T2 may turn on in response to a voltage provided to the first node N1. A gate electrode of the third switching transistor E_T3 may be coupled to the second clock line CLK2_L. The third switching transistor E_T3 may turn on in response to the second clock signal CLK2 provided through the second clock line. A gate electrode of the fourth switching transistor E_T4 may be coupled to a first clock line CLK1_L. The fourth switching transistor E_T4 may turn on in response to the first clock signal CLK1. A gate electrode of the seventh switching transistor E_T7 may be coupled to the first clock line CLK1_L. The seventh switching transistor E_T7 may turn on in response to the first clock signal CLK1. A gate electrode of the eighth switching transistor E_T8 may be coupled to the first node N1. The eighth switching transistor E_T8 may turn on in response to a voltage provided to the first node N1. A high-power voltage VGH provided through the power supply line may be provided to a second node N2 when the eighth switching transistor E_T8 turns on. A gate electrode of the ninth switching transistor E_T9 may be coupled to the second node N2. The ninth switching transistor E_T9 may be turn on in response to a voltage provided to the second node N2. A gate electrode of the tenth switching transistor E_T10 may be coupled to the first node N1. The tenth switching transistor E_T10 may turn on in response to the voltage provided to the first node N1. As described in FIG. 7, when the emission start signal FLM_E having a high level (e.g., VGH) is provided to the emission stage, the emission control signal EM[1] having a high level may be generated. Here, the emission control signal EM[1] may be synchronized with the first clock signal CLK1. The emission control signal EM[1] may maintain the voltage level while the emission start signal FLM_E is provided.

Figure 8:
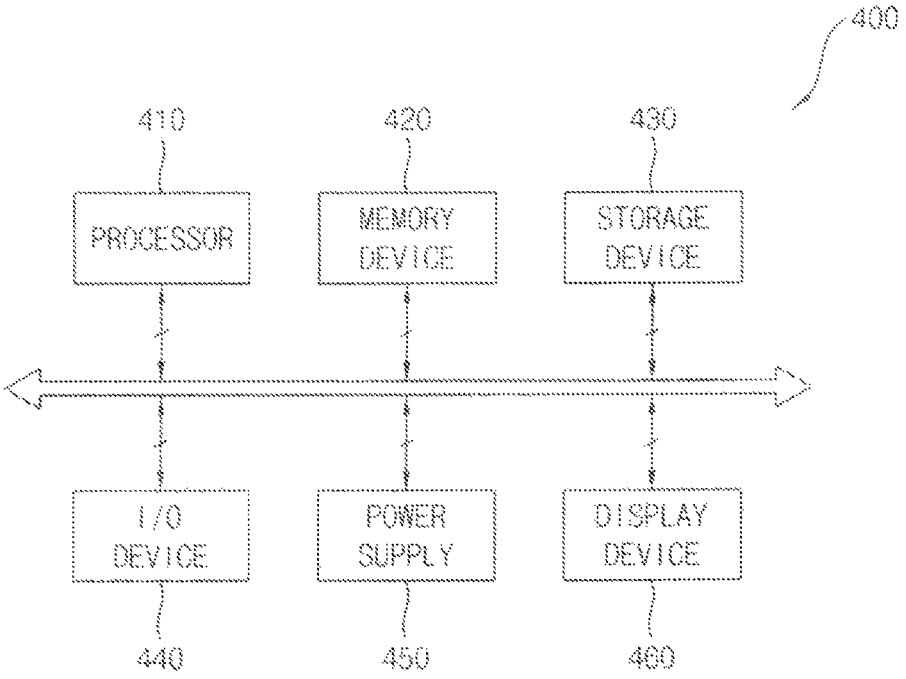
FIG. 8 is a diagram illustrating an electronic device according to example embodiments.
Figure 9:
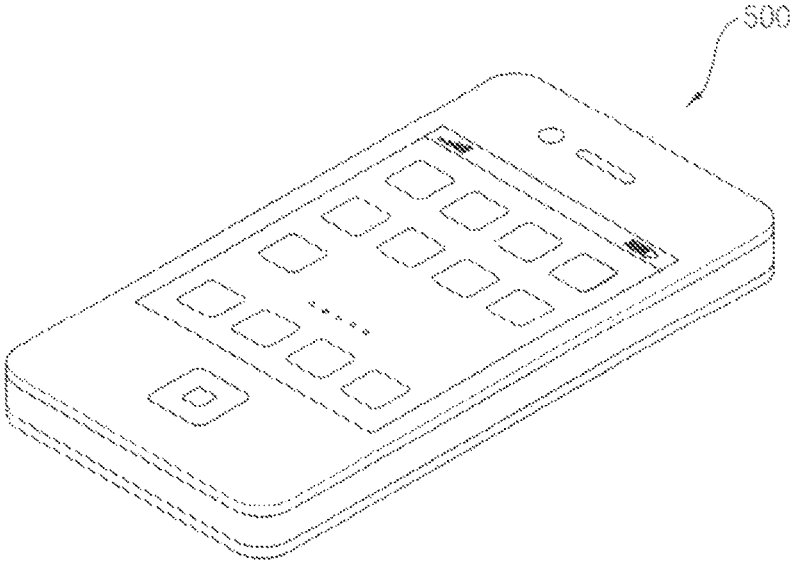
FIG. 9 is a diagram illustrating an example embodiment in which the electronic device of FIG. 8 is implemented as a smart phone.

FIG. 8 is a diagram illustrating an electronic device according to example embodiments, and FIG. 9 is a diagram illustrating an example embodiment in which the electronic device of FIG. 8 is implemented as a smart phone.

Referring to FIG. 8, an electronic device 400 may include a processor 410, a memory device 420, a storage device 430, an input/output (I/O) device 440, a power supply 450, and a display device 460. Here, the display device 460 may correspond to the transparent display device 100 of FIG. 1. In addition, the electronic device 400 may further include a plurality of ports for communicating with a video card, a sound card, a memory card, a universal serial bus (USB) device, other electronic device, etc. Although it is illustrated in FIG. 9 that the electronic device 400 is implemented as a smart phone 500, a kind of the electronic device 400 is not limited thereto.

The processor 410 may perform various computing functions. The processor 410 may be a micro processor, a central processing unit (CPU), etc. The processor 410 may be coupled to other components via an address bus, a control bus, a data bus, etc. Further, the processor 410 may be coupled to an extended bus such as a surrounded component interconnect (PCI) bus. The memory device 420 may store data for operations of the electronic device 400. For example, the memory device 420 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 430 may be a solid stage drive (SSD) device, a hard disk drive (HDD) device, a CD-ROM device, etc.

The I/O device 440 may be an input device such as a keyboard, a keypad, a touchpad, a touch-screen, a mouse, etc, and an output device such as a printer, a speaker, etc. In some example embodiments, the display device 460 may be included in the I/O device 440. The power supply 450 may provide a power for operations of the electronic device 400. The display device 460 may communicate with other components via the buses or other communication links. As described above, the display device 460 may include a pixel unit and a driving unit. The pixel unit may include a plurality of pixels. Each of the pixels may be operated based on the signals provided form the driving unit. Pads coupled to a driving circuit may be formed in a non-display area of a display panel. For example, the driving circuit may be implemented as an integrated circuit (IC) that includes a data driver and a timing controller. The pads may be coupled to a flexible printed circuit board (FPCB) on which the driving circuit implemented as the integrated circuit (IC) is mounted. The display panel may be electrically coupled to the driving circuit through the pads. The driving circuit may provide driving signals to the pads. The display panel may receive a first clock signal, a second clock signal, a scan start signal, and an emission start signal through the pads. The first clock signal may be provided to an emission driver through a first clock line coupled to the pad in the non-display area. The second clock signal may be provided to the emission driver through a second clock line coupled to the pad in the non-display area. The scan start signal may be provided to a scan driver through a scan start line coupled to the pad in the non-display area. The emission start signal may be provided to the emission driver through an emission start line coupled to the pad in the non-display area. The scan driver and the emission driver may be coupled through a first coupling line and a second coupling line. The emission driver may provide the first clock signal to the scan driver through the first coupling line. The emission driver may provide the second clock signal to the scan driver through the second coupling line. Thus, the number of clock lines that provides the clock signals may decrease. The data driver may convert an input data to a data signal corresponding to the input signal. The data driver may provide the data signal to the pixel unit through data lines formed in the pixel unit. The timing controller may control an operation of the display device 460. For example, the timing controller may control the operation of the display device 460 by providing timing control signals to the scan driver, the emission driver, and the data driver.

As described above, the electronic device 400 may include a display device 460 that commonly uses the clock signals provided to the scan driver and the emission driver. The display device 460 may decrease the number of the pads for coupling to the driving circuit by commonly using the clock signals provided to the scan driver and the emission driver. Thus, defects such as a static electricity occurred on the pads may decrease. Further, a dead space of the display device 460 may be reduced.

The present inventive concept may be applied to a transparent display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a pixel unit including a plurality of pixels; and a driving unit formed on a non-display area adjacent to the pixel unit, the driving unit configured to drive the pixels, wherein the driving unit includes:

an emission driver coupled to a first clock line and a second clock line and configured to receive therefrom a first clock signal and a second clock signal, respectively, and to generate an emission control signal provided to the pixels based on the first clock signal and the second clock signal; and a scan driver coupled to the emission driver through a first coupling line and a second coupling line, the scan driver configured to receive the first clock signal and the second clock signal from the emission driver and to generate a scan signal provided to the pixels based on the first clock signal and the second clock signal.

2. The display device of claim 1, wherein the emission driver sequentially generates the emission control signal based on an emission start signal, the first clock signal, and the second clock signal.

3. The display device of claim 1, wherein the emission driver includes a plurality of emission stages that generates the emission control signal provided to the pixels.

4. The display device of claim 3, wherein a first emission stage generates the emission control signal based on an emission start signal, the first clock signal, and the second clock signal and provides the emission control signal to the pixels in a first column.

5. The display device of claim 3, wherein an Nth emission stage generates the emission control signal based on a carry signal provided from an (N−1)th emission stage, the first clock signal, and the second clock signal and provides the emission control signal to the pixels in an Nth column, where the N is an integer equal to or greater than 2.

6. The display device of claim 1, wherein the scan driver sequentially generates the scan signal based on a scan start signal, the first clock signal, and the second clock signal.

7. The display device of claim 1, wherein the scan driver includes a plurality of scan stages that generates the scan signal provided to the pixel.

8. The display device of claim 7, wherein the scan driver includes a dummy scan stage.

9. The display device of claim 8, wherein the dummy scan stage generates the scan signal based on a scan start signal, the first clock signal, and the second clock signal and provides the scan signal to the pixels in a first column as a first scan signal.

10. The display device of claim 8, wherein a first scan stage generates the scan signal based on a carry signal provided from the dummy scan stage, the first clock signal, and the second clock signal, provides the scan signal to the pixels in a first column as a second scan signal, and provides the scan signal to the pixels in a second column as a first scan signal.

11. The display device of claim 7, wherein an Nth scan stage generates the scan signal based on a carry signal provided from an (N−1)th scan stage, the first clock signal, and the second clock signal, provides the scan signal to the pixels in an Nth column as a second scan signal, and provides the scan signal to the pixels in an (N+1)th column as a first scan signal, where the N is an integer equal to or greater than 2.

12. The display device of claim 1, wherein a plurality of pads are formed in the non-display area, and wherein the plurality of pads is coupled to a driving circuit and receives therefrom the first clock signal, the second clock signal, a scan start signal, and an emission start signal.

13. An electronic device includes a display device and a processor that controls the display device, wherein the display device comprising:

a pixel unit including a plurality of pixels; and a driving unit formed on a non-display area adjacent to the pixel unit, the driving unit configured to drive the pixels, wherein the driving unit includes:

an emission driver is coupled to a first clock line and a second clock line and configured to receive therefrom a first clock signal and a second clock signal, respectively, and to generate an emission control signal provided to the pixels based on the first clock signal and the second clock signal; and a scan driver coupled to the emission driver through a first coupling line and a second coupling line, the scan driver configured to receive the first clock signal and the second clock signal from the emission driver and to generate a scan signal provided to the pixels based on the first clock signal and the second clock signal.

14. The electronic device of claim 13, wherein the emission driver includes a plurality of emission stages that sequentially generates the emission control signal based on an emission start signal, the first clock signal, and the second clock signal.

15. The electronic device of claim 13, wherein the scan driver includes a plurality of scan stages that sequentially generates the scan signal based on a scan start signal, the first clock signal, and the second clock signal.

16. The electronic device of claim 13, wherein the scan driver includes a dummy scan stage.

17. The electronic device of claim 16, wherein the dummy scan stage generates the scan signal based on a scan start signal, the first clock signal, and the second clock signal and provides the scan signal to the pixels in a first column as a first scan signal.

18. The electronic device of claim 16, wherein a first scan stage generates the scan signal based on a carry signal provided from the dummy scan stage, the first clock signal, and the second clock signal, provides the scan signal to the pixels in a first column as a second scan signal, and provides the scan signal to the pixels in a second column as a first scan signal.

19. The electronic device of claim 16, wherein an Nth scan stage generates the scan signal based on a carry signal provided from an (N−1)th scan stage, the first clock signal, and the second clock signal, provides the scan signal to the pixels in an Nth column as a second scan signal, and provides the scan signal to the pixels in an (N+1)th column as a first scan signal, where the N is an integer equal to or greater than 2.

20. The electronic device of claim 13, wherein a plurality of pads are formed in the non-display area, and wherein the plurality of pads is coupled to a driving circuit and receives therefrom the first clock signal, the second clock signal, a scan start signal, and an emission start signal.

* * * * *